United States Patent [19]

Svoboda

[11] Patent Number: 4,825,654

[45] Date of Patent: May 2, 1989

[54] STEAM PLANT AND METHOD OF CONTROLLING SAME

[75] Inventor: Cenek Svoboda, Dubendorf, Switzerland

[73] Assignee: Sulzer Brothers Limited, Winterthur; Switzerland

[21] Appl. No.: 231,153

[22] Filed: Aug. 11, 1988

[30] Foreign Application Priority Data

Sep. 22, 1987 [CH] Switzerland ..... 03650/87

[51] Int. Cl.[4] ..... F01K 13/02

[52] U.S. Cl. ..... 60/665; 60/667

[58] Field of Search ..... 60/664, 665, 667

[56] References Cited

U.S. PATENT DOCUMENTS 3,125,073 3/1964 Profos ..... 60/667 X 4,213,304 7/1980 Morse ..... 60/667 X

*Primary Examiner*—Allen M. Ostrager

*Attorney, Agent, or Firm*—Kenyon & Kenyon

[57] ABSTRACT

The steam plant is operated so that the temperature of the steam entering the water separator is compared with the saturation temperature of the steam in the separator in order to produce a temperature difference signal for control of a changeover element. When the temperature difference is less than or equal to zero, the changeover element is activated to deliver a signal corresponding to the level of water in the separator for the control of the plant. When the temperature difference signal is greater than a critical value, the changeover element is actuated to deliver a signal corresponding to the temperature of the steam downstream of the separator for the control of the plant. When the temperature difference is greater than zero and less than the critical value, the changeover element is retained in the previously activated state.

9 Claims, 1 Drawing Sheet

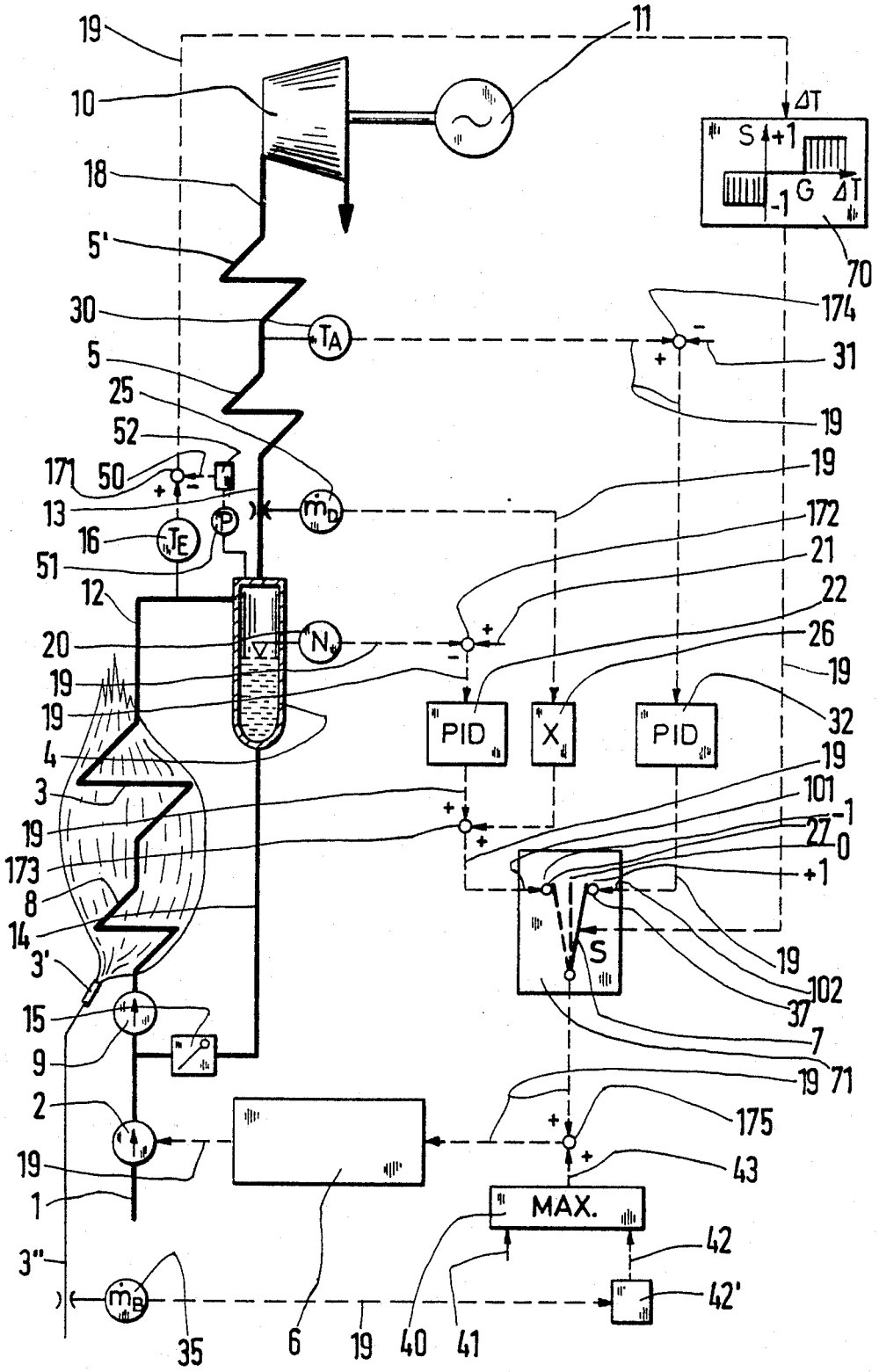
19
11
10
ΔT
S
+1
G
ΔT
-1
18
5'
70
30
174
TA
31
5
25
19
52
171
50
19
13
172
16
TE
21
51
22
12
20
N
26
19
19
PID
X
PID
32
19
4
3
101
19
-1
27
0
173
+1
8
14
S
19
3'
102
37
15
7
9
19
71
2
175
19
43
1
MAX.
3"
42
42'
35
6
19
40
41

STEAM PLANT AND METHOD OF CONTROLLING SAME

This invention relates to a steam plant and to a method of controlling the steam plant. More particularly, this invention relates to a method of controlling the feed water quantity of a fossil fired steam plant.

As is known, steam plants have been controlled in various manners. For example, Swiss Patent No. 517,266 describes a steam plant having a feed water pump disposed in a feed water line, an evaporator disposed downstream of the pump, a water separator disposed downstream of the evaporator, a control means for controlling the feed water quantity, and a changeover element through which, at low load on wet steam, a first signal triggered by the water level in the water separator acts on the control means and, at high load on dry steam, a second signal triggered by the steam temperature downstream of the water separator acts on the control means. By means of this technique, the feed water pressure measured at a measuring station in the feed water line between the feed water pump and the evaporator controls the changeover element. This method operates satisfactorily for unequivocally low loads on wet steam and for unequivocally high loads on dry steam. However, this method has proved unsatisfactory for loads in the load range of 45% around the point of changeover between wet steam and dry steam since the changeover element tends to oscillate cyclically between the two kinds of control.

Also, a variety of factors, such as the extent of soiling of the water and steam lines downstream of a pressure-measuring station affect the feed water line pressure. These factors lead to undesirable control fluctuations and are particularly aggravating in the critical 45% load range.

Accordingly it is an object of the invention to improve the control of the changeover element in plants of the above type that such control operates reliably at all loads and remains substantially unaffected by disturbance in the plant.

It is another object of the invention to control a steam plant in a reliable manner during changeover from wet steam to dry steam operation and vice versa without cyclic oscillations.

Briefly, the invention provides a steam plant and a method of controlling the steam plant.

The steam plant includes a feed water line for conveying a flow of feed water, a feed water pump in the line for pumping feed water therethrough, an evaporator in the line downstream of the pump for heating the flow of feed water to steam, a water separator in the line downstream of the evaporator for separating water from steam flowing therethrough and a control means for controlling the feed water quantity in the line. The plant also has a means for generating a first signal in response to the level of water in the separator and a means for generating a second signal in response to the steam temperature downstream of the separator. Still further, the plant has a changeover element connected to the control means and selectively connected to the two means for generating the signals in order to selectively deliver one of the signals to the control means for controlling the control means in response thereto.

In accordance with the invention, a means is provided for determining a temperature difference between the steam temperature upstream of the separator and the saturation temperature of the steam in the separator. Also, a comparator is provided for comparing the temperature difference with a selected critical value in order to deliver a control signal to the changeover element in response thereto. In this respect, the changeover element is actuated to deliver the first signal (corresponding to the level of water in the separator) to the control means when the temperature difference is less than or equal to zero. Further, the control signal is such as to actuate the changeover element to deliver the second signal (corresponding to the steam temperature downstream of the separator) to the control means when the temperature difference is greater than the critical value. Still further, the control signal is such as to retain the changeover element in a previously activated state when the temperature difference is greater than zero and less than the critical value.

In accordance with the method, the difference $\Delta T$ between the steam temperature at the water separator entry and the saturation temperature of the steam is formed at the associated water separator pressure, said temperature difference is compared with a critical temperature $G \geqq 0°$ C., and the changeover element is so actuated that the first signal acts on the control means at temperature differences $\Delta T$ less than or equal to zero, the second signal acts on the control means at temperature differences $\Delta T$ greater than the critical value G, and the immediately previous first or second signal continues to act on the control means at temperature difference $\Delta T$ greater than zero but less than or equal to the critical value.

The comparison of the steam temperature at the water separator exit with the saturation temperature of the steam at the associated water separator pressure determines unequivocally and in a manner unaffected by disturbing factors the water content of the steam entering the water separator. Also, the selection of a critical temperature in the critical load range obviates uncontrolled oscillation of the feed water quantity. The critical temperature is determined or selected for each plant experimentally in such a way that the cyclic variations of the changeover element hereinbefore referred to are obviated.

A third signal may also be generated in response to the quantity of fuel delivered to the plant for addition to the signal which is delivered via the changeover element in response to the plant exceeding a preselected minimum load. This ensures rapid adaptation of feed water quantity to changes in firing. The minimum load may also be selected at a value corresponding to a point of changeover between wet steam and dry steam. This prevents the third signal from being effective when wet steam is present at the water separator entry, for in this operative state the third signal normally acts against the required control pattern since, for example, in the event of a load increase the third signal produces a parallel increase in feed water quantity by increasing the infeed of fuel, so that less steam is produced, with the result of unwanted heating of the steam lines disposed after the water separator.

These and other objects and advantages of the invention will become more apparent from the following detailed description taken in conjunction with the accompanying drawing wherein:

The drawing diagrammatically illustrates a steam plant constructed in accordance with the invention.

Referring to the drawing, the steam plant includes a feed water line 1 for conveying a flow of feed water and a feed water pump 2 in the line 1 for pumping feed water therethrough. In addition, an evaporator 3 is disposed in the line 1 downstream of the pump 2 for heating the flow of feed water to steam while a water separator 4 is disposed downstream of the evaporator 3 for separating water from steam flowing therethrough.

A control means 6 is provided for controlling the fed water quantity in the line 1, for example by controlling the pump 2 or by controlling a valve in the line 1. The control means 6 is, in turn, provided with a signal from a changeover element 7 within a control unit 71 for the control of the control means 6. A fossil fuel fired firing 3' is also provided to supply the evaporator 3 with the heat necessary for evaporation. As indicated, a fuel feed line 3'' is provided for supplying fuel to the firing 3'.

An economizer 8 which is also heated by the firing 3' is disposed between the pump 2 and the evaporator 3. On the steam side, the water separator 4 is followed by a pair of steam superheaters 5, 5' which are connected in series with one another via a connecting line. A circulating pump 9 is also provided in the feed line 1 between the pump 2 and the economizer 8 to circulate water accumulating in the separator 4. To this end, a line 14 connects the water outlet of the water separator 4 via a check valve 15 to the feed line 1 upstream of the circulating pump 9 to permit the circulation of water. The check valve 15 prevents water from flowing into the separator 4 from the feed water line 1.

The evaporator 3 and an inlet of the water separator 4 are connected via a line 12 while a steam exit line 13 connects the water separator 4 to the first superheater 5 on the steam side.

The exit of the second superheater 5' is connected by a steam line 18 to a steam turbine 10 which drives a generator 11. The outlet of the turbine 10 is connected to the feed water line 1 by way of pipe work, heat exchangers, condenser, possibly a water treatment plant and a feed water tank (none of which is shown). The feed water tank is also provided with a connection for fresh water. If required, resuperheaters for the steam turbine 10 can be provided.

The plant is also provided with a means for generating a signal in response to the level of water in the separator 4. This means includes a gauge 20 which transmits a signal proportional to the water level in the separator via a signal line 19 to a comparator 172 in which the latter signal is compared with a water level set value 21. Any difference between the two signals is supplied via a signal line 19 to a PID controller 22 and thereby to a further comparator 173.

A flow meter 25 is also disposed in the exit line 13 from the water separator 4 to generate a signal which is proportional to the steam flow $m_D$ through the line 13 for delivery via a further signal line 19 and a member 26 for attenuating signal strength to the comparator 173. Summation of the signals from the water level gauge 20 and the flow meter 25 by the comparator 173 provides a first signal 101 which is delivered via a signal line 19 to a first contact 27 of the changeover element 7.

The plant is also provided with a means for generating a signal in response to the steam temperature downstream of the separator 4. As indicated, a temperature measuring device 30 is connected to the connecting line between the two superheaters 5, 5' for measuring the steam temperature therein and for delivering a signal which is proportional to the steam temperature $T_A$. This signal is delivered via a further signal line 19 to a comparator 174 along with a temperature set value signal 31 so that any difference therebetween is delivered via the control line 19 to a PID controller 32 which generates a second signal 102 for delivery via a signal line 19 to a second contact 37 of the changeover element 7.

The plant is further provided with a means for determining a temperature difference between the steam temperature upstream of the separator 4 and the saturation temperature of the steam in the separator 4. As indicated, this means includes a temperature measuring device 16 for measuring the temperature in the line 12 to the inlet of the water separator 4. This temperature measuring device 16 produces a signal proportional to the steam temperature $T_E$ at the entry to the water separator 4. A sensor 51 is also provided on the water separator 4 to measure the water separator pressure and to supply a proportional signal to a device 52 in which the associated saturation temperature 50 is ascertained. A signal corresponding to the ascertained saturation temperature 50 is then supplied to a comparator 171 along with the steam temperature signal. Any difference $\Delta T$ between the steam temperature $T_E$ and the saturation temperature is then measured and a corresponding signal is delivered via a signal line 19 to a control element 70 which acts via another signal line 19 on the changeover element 7 in the control unit 71.

In response to the temperature difference $\Delta T$, the changeover element 7 connects one of the two contacts 27, 37 to a fifth comparator 175 and, thus, by way of the control unit 71 transmits the "first" or "second" signal to the comparator 175.

The plant is also provided with a means for generating a third signal in response to the quantity of fuel delivered to the plant and means for adding the signal to the signal delivered to the control means 6. As illustrated, the means for generating the third signal includes a flow meter 35 for measuring the fuel quantity $m_B$ in the fuel feed line 3''. The flow meter 35 transmits a signal which is proportional to the fuel feed quantity and which is converted in a dynamic member 42' to a signal 42 which can be compared with a minimum load signal 41 in a maximum value member 40. The signal 41 reflects a preselected minimum load, for example a load which is selected at a value corresponding to a point of changeover between wet steam and dry steam. The maximum value member 40 generates a third signal 43 corresponding to the greater of the of the two signals 41, 42 and this signal 43 is supplied to the comparator 175 which serves as a means for adding the signal 43 to the signal from the changeover element 7 for delivery to the control means 6 for acting on the feed water quantity.

The control means 6 is of a conventional construction adapted to act on the speed of the feed water pump 2 or on a valve in the feed water line or on both. Since such a means is known and is of no importance for the invention, no further description is believed to be necessary.

The steam-rising plant operates as follows:

The feed water pump 2 pumps feed water through the feed water line 1 into the economizer 8 where the water is heated by the firing 3', the preheated water flowing from the economizer 8 to the evaporator 3. The feed water is evaporated therein by further action by the firing 3' and issues as wet or dry steam through the line 12 into the water separator 4. The separator separates the liquid and vapor phases of the entering steam from one another, the liquid phase being returned by means of the pump 9 through the water outlet line 14 and check valve 15 to the feed water line 1 while the dry steam flows through the steam outlet line 13 to the superheaters 5, 5'. The superheated steam flows therefrom through the steam line 18 to the steam turbine 10 where the steam expands and performs work to produce electricity in the generator 11.

The temperature difference ΔT detected in the comparator 171 is evaluated in the control element 70 which issues a corresponding instruction signal S such that:

S = −1 when the temperature difference is less than or equal to zero;

S = +1 when the temperature difference is greater than a critical value G; and

S = 0 when the temperature difference is greater than zero but less than or equal to the critical value G.

When S = −1, the changeover element 7 is connected to the first contact 27 and transmits the "first signal" to the control means 6. When the signal S = +1 the changeover element 7 contacts the second contact 37 and transmits the "second signal". When S = 0, the changeover element 7 remains in a neutral position, the first or second signal which has been supplied immediately previously to the fifth comparator 175 being retained by means of the control unit 71 and continuing to be supplied to the fifth comparator 175.

The critical value G ≧ 0° C. is determined empirically for the steam-raising plant to be as low as possible, yet to be such that in the critical 45% load range where the changeover between wet steam and dry steam occurs, the signal S = 0 reaches the changeover element 7 to prevent uncontrolled fluctuation of the feed water quantity. In practice, G is preferably chosen to be below 30° C., and it is found by experience, in most cases, that G can equal 0° C. without such fluctuations occurring.

It is very important that the changeover element 7 should change over smoothly between signals. This can be attended to by appropriate determination of the I-proportion of the PID controllers 22, 32 and by means of the control unit 71.

The first or second signal from the changeover element 7 is added to the "third signal" in the fifth comparator 175 and supplied to the means 6 for controlling feed water quantity. Consequently, the control takes account of the fuel quantity $m_B$ which is flowing to the firing 3' and which is an important factor for load determination, as well as of the alteration of the water level in the water separator 4 and of the steam temperature $T_A$ downstream thereof.

Thus, during usual operation, at low load on wet steam, the changeover element 7 permits a first signal to be triggered by the water level in the water separator 4 in order to act on the control means 6. At high load on dry steam, the changeover element 7 permits a signal triggered by the steam temperature $T_A$ downstream of the water separator 4 to act on the control means 6.

The invention thus provides a steam plant as well as a method of controlling a steam plant wherein oscillations between wet steam and dry steam operation for loads in the region of the point of changeover can be eliminated.

What is claimed is:

1. A steam plant comprising a feed water line for conveying a flow of feed water;

a feed water pump in said line for pumping feed water therethrough;

an evaporator in said line downstream of said pump for heating the flow of feed water to steam;

a water separator downstream of said evaporator for separating water from steam flowing therethrough;

control means for controlling the feed water quantity in said line;

first means for generating a first signal in response to the level of water in said separator;

second means for generating a second signal in response to the steam temperature downstream of said separator;

a changeover element connected to said control means and selectively connected to said first means and said second means to selectively deliver one of said signals to said control means for controlling said control means in response thereto;

means for determining a temperature difference between the steam temperature upstream of said separator and the saturation temperature of the steam in said separator; and a comparator for comparing said temperature difference with a selected critical value to deliver a control signal to said changeover element in response thereto whereby said changeover element is actuated to deliver said first signal to said control means when said temperature difference is less than or equal to zero, said changeover element is actuated to deliver said second signal to said control means when said temperature difference is greater than said critical value, and said changeover element is retained in a previously activated state when said temperature difference is greater than zero and less than said critical value.

2. A steam plant as set forth in claim 1 further comprising a first controller for delivering said first signal to said control means and a second controller for delivering said second signal to said control means.

3. A steam plant as set forth in claim 2 wherein each controller is a PID controller.

4. A steam plant as set forth in claim 1 further comprising at least one steam superheater downstream of said separator for heating a flow of steam therefrom, and wherein said second means is disposed downstream of said superheater to generate said second signal thereat.

5. A steam plant as set forth in claim 4 further comprising a pair of steam superheaters downstream of said separator and a connecting line therebetween, said second means being connected to said connecting line to generate said second signal thereat.

6. A steam plant as set forth in claim 1 further comprising means for generating a third signal in response to the quantity of fuel delivered to the plant and means for adding said third signal to said signal delivered to said control means in response to the plant exceeding a preselected minimum load.

7. A steam plant as set forth in claim 6 wherein said minimum load is selected at a value corresponding to a point of changeover between wet steam and dry steam.

8. A method of controlling a steam plant having a feed water line for conveying a flow of feed water; a feed water pump in said line for pumping feed water therethrough; an evaporator in said line downstream of said pump for heating the flow of feed water to steam; a water separator downstream of said evaporator for separating water from steam flowing therethrough; and control means for controlling the feed water quantity in said line; said method comprising the steps of generating a first signal in response to the level of water in said separator;

generating a second signal in response to the steam temperature downstream of said separator;

delivering one of said signals to said control means for controlling said control means in response thereto;

determining a temperature difference between the steam temperature upstream of said separator and the saturation temperature of the steam in said separator;

delivering said first signal to said control means when said temperature difference is less than or equal to zero;

delivering said second signal to said control means when said temperature difference is greater than a selected critical value; and maintaining the previously delivered signal to said control means when said temperature difference is greater than zero and less than said critical value.

9. A steam plant as set forth in claim 8 which further comprises the step of generating a third signal in response to the quantity of fuel delivered to the plant and adding said third signal to said signal delivered to said control means in response to the plant exceeding a preselected minimum load.

* * * * *